US005393066A

United States Patent [19]

Reinitz

[11] Patent Number: 5,393,066

[45] Date of Patent: Feb. 28, 1995

[54] BOARD GAME AND METHOD OF PLAY

[76] Inventor: Margaret L. Reinitz, 801 W. Ladybird La., Burnsville, Minn. 55337

[21] Appl. No.: 294,977

[22] Filed: Aug. 24, 1994

[51] Int. Cl.[6] ..... A63F 3/00

[52] U.S. Cl. ..... 273/236; 273/282.3; 273/288

[58] Field of Search ..... 273/236, 282.3, 288, 273/290, 241, 275

[56] References Cited

U.S. pATENT DOCUMENTS

| | | | |
|---|---|---|---|
| D. 31,656 | 10/1899 | La Monda | D21/19 |
| 606,744 | 7/1898 | St. John | 273/239 |
| 825,809 | 7/1906 | Connell | 273/293 |
| 1,004,935 | 10/1911 | Taylor | 273/148 A |
| 1,034,402 | 7/1912 | Hardy | 273/294 |
| 2,072,605 | 3/1937 | Palmer | 273/294 |
| 2,253,823 | 8/1941 | Suteras | 273/293 |
| 2,384,280 | 9/1945 | Cardozo | 434/258 |
| 2,391,147 | 12/1945 | Fredricksson | 273/288 |
| 2,457,020 | 12/1948 | Whitney | 273/292 |
| 2,887,789 | 5/1959 | Bobo et al. | 273/282.3 |
| 3,224,780 | 12/1965 | Mohl | 273/148 A |
| 3,481,603 | 12/1969 | Sugden | 273/290 |
| 3,638,948 | 2/1972 | Smith | 273/275 |
| 3,761,094 | 9/1973 | Belisle | 273/148 A |
| 3,804,415 | 4/1974 | Ryan | 273/282.3 |
| 3,986,275 | 10/1976 | Kleine-Horst | 273/148 A |
| 4,659,085 | 4/1987 | DeVries | 273/236 |
| 5,116,061 | 5/1992 | Zentner, Jr. | 273/241 |

*Primary Examiner*—Benjamin H. Layno
*Attorney, Agent, or Firm*—Nawrocki, Rooney & Sivertson

[57] ABSTRACT

A board game having a game board with a generally planar upper surface and a plurality of pegs protruding generally perpendicular therefrom. The pegs are arranged in a closed geometric pattern, preferably a circle, with adjacent pegs spaced equidistant from one another. The game board is utilized in conjunction with a plurality of game pieces having a pair of generally planar opposing surfaces with a first hole and a second hole extending therethrough. The spacing between the first hole and the second hole is approximately equal to the spacing between adjacent pegs so that the game pieces can be slidably received over any pair of adjacent pegs. The game pieces further include a first and a second means for indicating value, wherein the first means for indicating value is located proximate the first hole and the second means is located proximate the second hole. One of the opposing surfaces of each game piece is preferably subdivided into a first half and a second half with a hole and means for indicating value associated with each half. A method for utilizing the game board and game pieces is further disclosed.

22 Claims, 3 Drawing Sheets

BOARD GAME AND METHOD OF PLAY

TECHNICAL FIELD

The present invention relates to a board game including a game board and game pieces. More narrowly, it is directed to a game board having a plurality of equidistant pegs arranged in a closed geometric pattern protruding from a surface thereof, and a plurality of game pieces having first and second means for indicating value associated with a portion of the game piece which is slidably receivable over one of a pair of adjacent pegs. The present invention is also directed to a method of playing a board game utilizing the above apparatus.

BACKGROUND OF THE INVENTION

Board games utilizing a game board and game pieces are generally known. Prior art disclosures include many variations of game boards having pegs protruding therefrom. Other prior art discloses include game pieces having holes therethrough for slidable engagement with the pegs of the game board.

For example, St. John (U.S. Pat. No. 606,744) discloses a game board and method of play. The game board disclosed includes multiple arrays of pegs protruding from a rectangular surface. The pegs are utilized for receiving magnetic rings. When playing the game, each contestant utilizes a magnetized rod to pick up rings from the central pegs and transfer them to pegs located near the edge of the game board. Players race to see who fills their pegs first.

Fredriksson (U.S. Pat. No. 2,391,147) discloses a game board including a rectangular surface having pegs protruding therefrom arranged in a cross-shaped pattern. A "goal" peg is located at the end of each arm of the cross. The game pieces are rings or flat pieces having a single hole in it closer to one end. The object of the game is for a player to get his rings into the cup opposite his own field.

La Monda (U.S. Pat. No. DES 31,656) also discloses a game board having an array of pegs protruding therefrom. Each of the game boards disclosed in these references utilize game pieces that are ring-shaped or have a single hole therethrough to function as a ring would function.

Other game boards have been designed utilizing pegs and associated game pieces for specific applications where it is necessary for holding game pieces in a particular location. For example, Taylor (U.S. Pat. No. 1,004,935) and Belisle (U.S. Pat. No. 3,761,094) each disclose a device for holding playing cards in an overlapped position so that each card is sufficiently exposed from behind its overlapping card to show its suit and value. These game boards allow playing of solitaire without the necessity of laying the cards on a flat horizontal surface.

Kleine-Horst (U.S. Pat. No. 3,986,275), Bobo et al. (U.S. Pat. No. 2,887,789) and Cardozo (U.S. Pat. No. 2,384,280) disclose boards having pegs protruding therefrom and associated game pieces used in conjunction with these pegs for educational purposes. Kleine-Horst discloses an educational tool which incorporates cards and pegs, wherein the cards have holes which correspond to a given peg when the card is properly placed. Bobo et al. disclose an educational game board which utilizes pegs and cards with holes matching the arrangement of a given set of pegs once such a card is placed in proper position. The positions are dictated by mathematical problems, words or pictures. Cardozo discloses an educational toy including a holder having two pegs protruding therefrom for keeping in order cards, which when properly arranged, sequence a story.

Several prior art disclosures have also been directed to the design of game pieces. For example, Suteras (U.S. Pat. No. 2,253,823) discloses an improved set of dominoes which incorporate numbers rather than dots, and also can include colors designating a specific number. Hardy (U.S. Pat. No. 1,034,402) discloses variations on the design of the face of playing cards, including value indication and shape. Sugden (U.S. Pat. No. 3,481,603) discloses a three-dimensional tic-tac-toe game. The game pieces are rectangular, having two holes spaced apart, with two different color playing symbols for playing tic-tac-toe. Whitney (U.S. Pat. No. 2,457,020) discloses a normal set of playing cards with which all of the games of dominos can be played.

Several card games board games have also been disclosed in which cards are played in an arrangement based on matching numbers or letters of adjacent cards. For example, Devries (U.S. Pat. No. 4,659,085) discloses a game board having rectangular partitions and rectangular game pieces. The pieces are played on the board with alignment of numbers when they correspond. Connell (U.S. Pat. No. 825,809) discloses a card game apparatus which includes a polygonal center piece whose several sides are inscribed with numerals in a series of rectangular cards, each bearing two numerals. The game includes eight books of rectangular cards, each book containing the following cards: 1-2, 2-3, 3-4, 4-5, 5-6, 6-7, 7-8, and blank-blank. Thus, there are 72 cards in total, with eight of any one card. As shown in the figure on page 1 of the patent, the cards are played so as to branch out from the central polygonal pieces with numbers matching. The object is to block play in a given direction by bridging across two previously played cards. Palmer (U.S. Pat. No. 2,072,605) discloses game pieces and a method of play incorporating hexagonal pieces that have alternating numbers and letters along the six edges. The object of the game is to arrange the cards in a geometric shape and spell words for points when a pattern is completed.

The above described disclosures fail to teach a board game and game piece combination which is readily usable by small children to learn both colors and numbers, while providing a challenging game which aids in keeping the players interested in continuing play, while learning. The present invention addresses the needs not met by the prior art, as well as addressing other problems associated with game boards and game pieces for use by small children. The present invention also offers further advantage over the prior art and solves problems associated therewith.

SUMMARY OF THE INVENTION

The present invention is a board game, including a game board and game pieces, and a method of utilizing the board game. The game board and game pieces are specifically designed and intended for use by smaller children to assist in learning numbers, colors or both, while providing a challenging game which maintains the interest of both young children, older children and adults.

The board game of the present invention first includes a game board having a generally planar upper surface. The upper surface has a plurality of pegs protruding generally perpendicular therefrom, and the pegs are arranged in a closed geometric pattern with adjacent pegs spaced generally equidistant from one another. By closed geometric pattern, it is meant any geometric shape which has a single continuous perimeter defined by the pegs which are all spaced an equal distance apart with only two pegs adjacent any peg. Such geometric patterns can include a circle, ellipse, rectangle or square. In a preferred embodiment, a circle is utilized. The circle includes 26 pegs protruding from the planar upper surface of the geometric pattern in a preferred embodiment.

The game pieces to be used in conjunction with the above game board include a plurality of game pieces having a pair of generally planar opposing surfaces with a first hole and a second hole extending therethrough. The spacing between the first hole and the second hole is about equal to the spacing between adjacent pegs on the game board so that the game pieces can be slidably received over any pair of adjacent pegs. The game pieces further include a first and a second means for indicating value with the first means located proximate the first hole and the second means located proximate the second hole to show affiliation, association, or correspondence therewith.

In a preferred embodiment, one of the generally planar opposing surfaces of the game pieces is subdivided into a first half and a second half. The first half includes the first hole and the first means for indicating value, while the second half of the surface includes the second hole and the second means for indicating value. The generally planar opposing surfaces can be rectangular in shape.

The first means for indicating value and the second means for indicating value can include numbers or blanks, or alternatively, can include color. In a preferred embodiment, the means for indicating value is a combination of a number or blank and a color corresponding thereto.

In a preferred embodiment, the plurality of game pieces includes 55 pieces having first means for indicating value and second means for indicating value, including the following combination of values, respectively:

| | | | | | | | | | |
|---|---|---|---|---|---|---|---|---|---|
| blank-1 | 1-1 | 2-2 | 3-3 | 4-4 | 5-5 | 6-6 | 7-7 | 8-8 | 9-9 |
| blank-2 | 1-2 | 2-3 | 3-4 | 4-5 | 5-6 | 6-7 | 7-8 | 8-9 | |
| blank-3 | 1-3 | 2-4 | 3-5 | 4-6 | 5-7 | 6-8 | 7-9 | | |
| blank-4 | 1-4 | 2-5 | 3-6 | 4-7 | 5-8 | 6-9 | | | |
| blank-5 | 1-5 | 2-6 | 3-7 | 4-8 | 5-9 | | | | |
| blank-6 | 1-6 | 2-7 | 3-8 | 4-9 | | | | | |
| blank-7 | 1-7 | 2-8 | 3-9 | | | | | | |
| blank-8 | 1-8 | 2-9 | | | | | | | |
| blank-9 | 1-9 | | | | | | | | |
| blank-blank | | | | | | | | | |

In another preferred embodiment, the game pieces include the above combination of numbers and, in addition, include one of ten different colors, each different color corresponding to a given number or blank. The type of means for indicating value utilized with the present invention can be selected to focus the education of small children to colors or numbers while utilizing the game.

The board game of the present invention can further include a game piece holder. The holder includes a first member having a first peg protruding therefrom, and a second member having a second peg protruding therefrom. The first member and the second member are sized to slidably engage one another with the first and the second peg spaced a distance equal to the distance between the first and the second hole in each of the game pieces. When assembled, the game piece holder can be utilized to store the game pieces when not in use. When taken apart, each of two players may utilize a portion of the holder to hold their game pieces in a particular order.

The present invention also includes several distinct methods of play for utilizing the game board and game pieces described above. The method of play can include at least a first player and a second player and preferably up to four players.

The players each randomly select five game pieces in a preferred method of play. The game pieces are arranged so that the first and the second means for indicating value are not visible while randomly selecting the five game pieces. The players further hold their selected game pieces so that they are not visible to other players. An agreed upon first player places a first game piece over any pair of adjacent pegs on the closed geometric pattern with the means for indicating value visible.

Play then passes to another player in a direction selected, with the second player placing a second game piece over a pair of adjacent pegs, including one peg of the pair utilized by the first game piece. The second game piece must have a first or second means for indicating value matching either the first or second means for indicating value of the first game piece. The matching means for indicating value is placed so that such matching portion of the game piece shares a common peg. The placement of the second game piece establishes a direction of play in either the clockwise or counter clockwise direction. This direction of play is then maintained.

If the second player holds no game piece having a first or second means for indicating value matching the first or second means for indicating value on the first game piece, the player randomly selects up to three additional game pieces from the remainder of the plurality of game pieces. If a game piece is selected from the remainder of the plurality which has a matching means for indicating value, the player places the first of the additional game pieces that includes either a first or a second means for indicating value that matches the first or second means for indicating value of the first game piece on a pair of adjacent pegs with matching means for indicating value overlapping one another as indicated above.

Play is alternated between players wherein each successive player places a game piece having a matching first or second means for indicating value over the non-overlapping half of the last game piece played until a player holds no more game pieces or until no more matches are possible by any player.

These and various other advantages and features of novelty which characterize the present invention are pointed out with particularity in the claims annexed hereto and forming a part hereof. However, for a better understanding of the invention, its advantages, and the object obtained by its use, reference should be made to the drawings which form a further part hereof, and to the accompanying descriptive matter in which there are illustrated and described preferred embodiments of the present invention.

BRIEF DESCRIPTION OF THE DRAWINGS

In the drawings, in which like reference numerals indicate corresponding parts or elements of preferred embodiments of the present invention throughout the several views.

DETAILED DESCRIPTION OF THE PREFERRED EMBODIMENTS

Detailed embodiments of the present invention are disclosed herein. However, it is to be understood that the disclosed embodiments are merely exemplary of the present invention which may be embodied in various systems. Therefore, specific details disclosed herein are not to be interpreted as limiting, but rather as a basis for the claims and as a representative basis for teaching one of skill in the art to various practice the invention.

Figure 1:
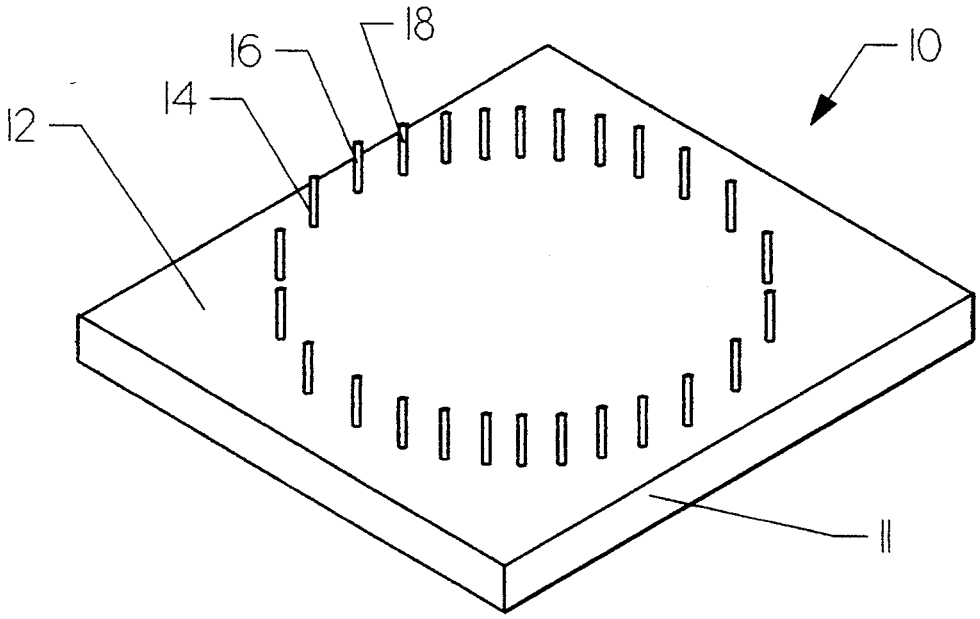
FIG. 1 is a perspective view of the game board of the present invention including a plurality of pegs protruding from a surface thereof.

The present invention is a board game which includes a game board having a plurality of pegs protruding generally from a surface thereof, and a plurality of game pieces for use in conjunction with the game board. Referring now to FIG. 1, a perspective view of a game board 10 embodying features of the present invention is depicted. The game board 10 includes a base 11 which has a generally planar surface 12. As depicted in FIG. 1, the generally planar surface 12 can be rectangular in shape, although it is recognized that other shapes of the base 11 would not be beyond the scope of the present invention.

The generally planar upper surface 12 of the base 11 of the game board 10 has a plurality of pegs 14, 16, for example, protruding generally perpendicular therefrom. The plurality of pegs 14, 16 are arranged in a closed geometric pattern with adjacent pegs 14, 16 spaced generally equidistant from one another.

As previously stated, the pegs 14, 16 are arranged in a closed geometric pattern. By closed geometric pattern, it is meant that the perimeter of the arranged pegs is continuous, with only two pegs aligned adjacent any given peg and equidistant therefrom. For example, a first peg 16 has adjacent to it two pegs, namely peg 14 and peg 18. No other pegs are equidistant therefrom. Examples of closed geometric patterns which satisfy limitations of the present invention include circles, ellipses, rectangles and squares. A preferred geometric pattern is that depicted in FIG. 1, which is circular in shape.

In one preferred embodiment, the game board 10 includes twenty-six pegs protruding from the planar upper surface 12 of the base 11. The game board 10, including the base 11 and pegs 14, 16, 18 are preferably molded from plastic. However, it is recognized that the base can be manufactured separate from the pegs with the pegs affixed to the base by drilling holes for insertion of such pegs. Other known construction techniques may also be utilized.

Figure 2:
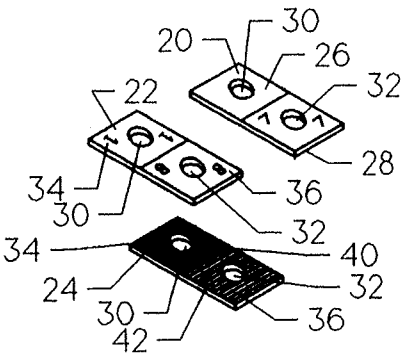
FIG. 2 is a perspective view of preferred game pieces including first and second means for indicating value, including numbers, a blank, or colors.

Now referring to FIG. 2, a perspective view of preferred game pieces 20, 22, 24 for utilization with the game board depicted in FIG. 1 are illustrated. The board game includes a plurality of game pieces 20, 22, 24, for example, each having generally planar opposing surfaces 26, 28 with a first hole 30 and a second hole 32 extending therethrough. The spacing between the first hole 30 and the second hole 32 is about equal to the spacing between any adjacent pegs 14, 16 on the game board 10. Thus, the game pieces 20, 22, 24 can be slidably received over any pair of adjacent pegs 14, 16. The game pieces 20, 22, 24 further include a first means for indicating value 34 and second means for indicating value 36, as depicted on game piece 22. The first means for indicating value 34 is located proximate the first hole 30, and the second means for indicating value 36 is located proximate the second hole 32.

The first means for indicating value 34 and the second means for indicating value 36 can include numbers, as depicted on game piece 22, or a combination of a number and a blank, as depicted on game piece 20. Alternatively, colors may be utilized for the first and second means for indicating value as depicted on game piece 24. In another alternative embodiment, the means for indicating value can be a combination of numbers or blanks, and a particular color included with and corresponding to a particular number or blank.

In preferred embodiments, the game pieces 20, 22, 24 have generally planar opposing surfaces 26, 28 which are rectangular in shape. Preferably, one of said generally planar opposing surfaces 26, 28 on each of the game pieces 20, 22, 24 is subdivided into a first half 40 and a second half 42 as depicted on game piece 24. The first half 40 includes the first hole 30 and first means for indicating value 34. A second half 42 includes the second hole 32 and second means for indicating value 36.

In a preferred embodiment, the board game 10 of the present invention includes fifty-five game pieces having first means for indicating value 34 and second means for indicating value 36, including the following combination of values, respectively:

| | | | | | | | | | |
|---|---|---|---|---|---|---|---|---|---|
| blank-1 | 1-1 | 2-2 | 3-3 | 4-4 | 5-5 | 6-6 | 7-7 | 8-8 | 9-9 |
| blank-2 | 1-2 | 2-3 | 3-4 | 4-5 | 5-6 | 6-7 | 7-8 | 8-9 | |
| blank-3 | 1-3 | 2-4 | 3-5 | 4-6 | 5-7 | 6-8 | 7-9 | | |
| blank-4 | 1-4 | 2-5 | 3-6 | 4-7 | 5-8 | 6-9 | | | |
| blank-5 | 1-5 | 2-6 | 3-7 | 4-8 | 5-9 | | | | |
| blank-6 | 1-6 | 2-7 | 3-8 | 4-9 | | | | | |
| blank-7 | 1-7 | 2-8 | 3-9 | | | | | | |
| blank-8 | 1-8 | 2-9 | | | | | | | |
| blank-9 | 1-9 | | | | | | | | |
| blank-blank | | | | | | | | | |

Thus, the game pieces include fifty-five combinations, none of which repeat. When the means for indicating value is chosen to be a color, the plurality of game pieces, fifty-five in the preferred embodiment, include ten different colors in combination, which, as with the numbers, do not repeat any combination for the fifty-five game pieces. In a preferred embodiment, a particular color is assigned as corresponding to a particular number or blank, and both the color and number are utilized on the portion of the game piece indicating that value. Thus, for instance, blank could be assigned the color red, while the number 9 is assigned the color green. The game piece corresponding to a value of blank-9 would thus have a first half with a blank and the color red and a second half with the number 9 indicated thereon along with being green in color.

As previously stated, the game pieces 20, 22, 24 preferably have rectangular planar surfaces. The thickness or distance between the planar surfaces can be adjusted to accommodate strength requirements depending upon the material of construction. The material of construction can include cardboard, although plastic is preferable for durability. The color selected to be utilized as a means for indicating value is preferably selected from those common colors which are taught at an early age for children. These could include a combination of ten, such as red, blue, green, yellow, purple, orange, white, black, pink, and grey.

Figure 4:
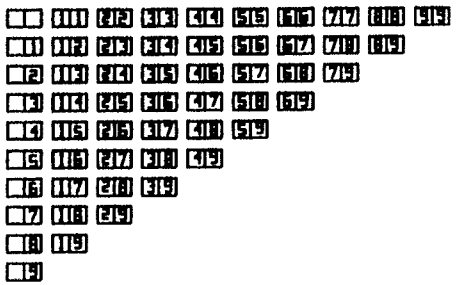
FIG. 4 is a tabular representation of a preferred array of game pieces and their respective combination of means for indicating value.

Referring now also to FIG. 4, the combination of means for values for means for indicating value in a preferred embodiment are illustrated. As can be seen from FIG. 4, no two combinations are repeated in the set of game pieces utilized.

Figure 3:
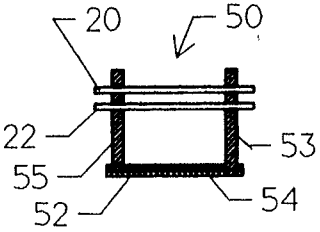
FIG. 3 is a partial cross-sectional view of a game piece holder assembled to hold game pieces thereon.

Referring now also to FIG. 3, a game piece holder 50 is depicted in partial cross-sectional view. The game piece holder has a first member 52 and a second member 54. The first member 52 has a peg 53 protruding therefrom, while the second member 54 has a peg 55 protruding therefrom. The first member 52 and the second member 54 are sized to slidably engage one another with the first peg 53 and the second peg 55 spaced a distance equal to the distance between the first hole 30 and second hole 32 in each of the game pieces 20, 22.

The holder 50 serves to keep the game pieces in order when playing solitaire or double solitaire, methods of play which are described hereinbelow. The holder 50 consists of the two separate pieces that form the sides and bottom of a box when assembled. When the first member 52 and the second member 54 are separated, each of the associated pegs can then be used to hold game pieces in play for two players in proper order.

Figure 5:
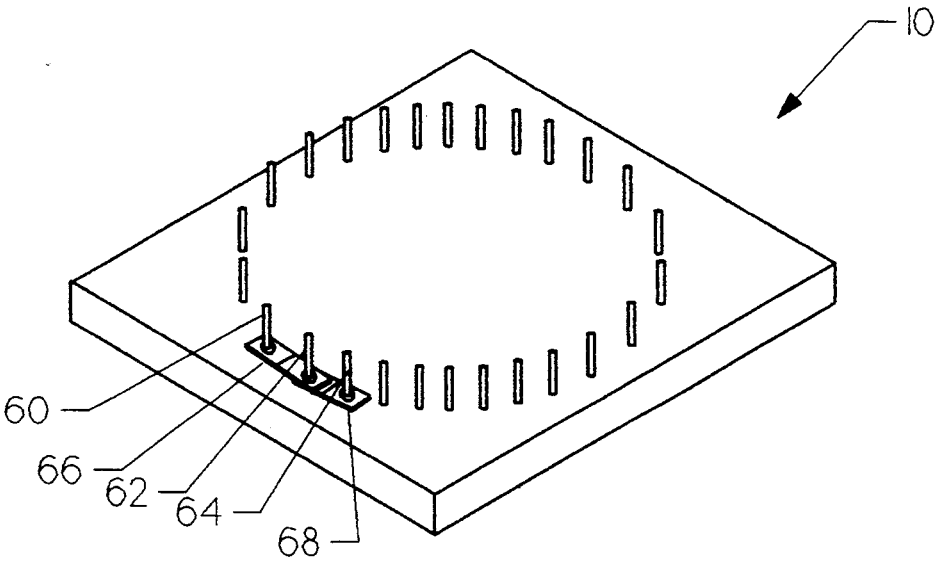
FIG. 5 is a perspective view of the game board of the present invention including two game pieces slidably received thereon as played in a preferred method of play.

Finally, referring to FIG. 5, a perspective view of the game board and game pieces 66, 68 in play in a preferred method of playing the present board game are illustrated. As can be seen in FIG. 5, each game piece 66, 68 is slidably received over a pair of adjacent pegs 60, 62 or 62, 64. Adjacent game pieces share a common peg 62 wherein a half of the game piece overlaps the other game piece half on the shared peg 62. The criteria for overlapping pieces is a matching of the means for indicating value.

A preferred method of play will now be described in conjunction with the above disclosure regarding FIG. 5. In a preferred method of play, the preferred plurality of game pieces, including fifty-five pieces described above, are utilized. The method of play can include at least a first player and a second player, preferably no more than 4 players. Play begins by first arranging the game pieces so that the first and second means for indicating value are not visible, while each player randomly selects five game pieces. The remainder of the game pieces are left, as randomly arranged, and kept with the means for indicating value not visible to the players. Further, the players hold their selected game pieces so that they are not visible to other players.

A first selected player then places a first game piece 68, as depicted in FIG. 5, over a pair of adjacent pegs 62, 64 with the means for indicating value visible.

A second player then places a second piece over a pair of adjacent pegs 62, 64. The pair of adjacent pegs, including one common peg 62 of the pair utilized by the first game piece 68. In order for the second player to place the second game piece 66, the game piece must have first or second means for indicating value matching either the first or second means for indicating value of the first game piece 68. The matching means for indicating value must share the common peg 62, as indicated in FIG. 5. The placement of the second game piece 66 establishes a direction of play in either the clockwise or counter clockwise direction. As depicted in FIG. 5, the direction of play would continue clockwise.

If the second player, as described above, holds no game pieces having a first or second means for indicating value matching the first or second means for indicating value on the first game piece, the second player must randomly select up to three additional game pieces from the remainder of the plurality of game pieces described above. Once such player selects a game piece having the required matching means for indicating value on one half, the player may then place the first one of the additional pieces that includes either a first or second means for indicating value that matches the first or second means for indicating value of the first game piece on a pair of adjacent pegs with the matching means for indicating value overlapping, as described above.

Play is then alternated between players wherein each successive player places a game piece having a matching first or second means for indicating value over the non-overlapping means for indicating value exposed on the previously placed game piece. The game piece must be selected from those held by the player or from up to three additional game pieces selected from the remainder of the plurality described above. Alternating play continues until a player no longer holds any game pieces or until no more matches are possible by any player. In the case of no more possible matches, the player with the least number of game pieces is winner.

In a modified method of play, if no match can be made, but a player has a double (a double is a game piece that has the same number or color on both halves as subdivided) such double may be played as a wild game piece. For example, if a game piece had a three disposed on the half in the direction of play, and the player had no game piece with a three, any double could be played. If the player had a double three, that game piece must be played as a regular game piece.

The game of the present invention can also be played as solitaire. A first game piece or starter game piece is picked at random from the scrambled, face down game pieces and placed anywhere on the game board. Play may be made on either end of the starter game piece, but must continue in which ever direction that is begun, as described above. The game pieces are picked one at a time from the face-down ones.

If possible, a game piece is played on the board based on matching a half of the game piece with that exposed on the game board. If the game piece cannot be played, it is placed face up on one of the pegs from the holder described above. The top game piece from this pile may be played on the board whenever possible, and cards from this source may be played as long as matches can be made. Game pieces must be kept in the same order throughout the game, however. Doubles, as described above, may be played like any other card until no more matches can possibly be made. Then, the first double left may be played to change the number or color.

The play continues until no further matches are possible, then the next double can be played to change the color and play again is exhausted. In this way, play continues until all game pieces have been played or until all doubles have been used and no more matches can be made.

As a third alternative method of play, double solitaire may be played with the game board and game pieces of the present invention. With double solitaire, the holder described above is separated so that each player has a storage box with one peg for unplayed cards. The first player is chosen by picking a card from the face down scrambled cards. The one with the highest number starts. A starter card or first card is picked and placed on the board. The first player may play on either end of this card, but play must continue in the same direction as it is begun. Play continues as long as matches can be made from the face down cards or the top card of each player's storage holder peg. Play continues as in single solitaire described above. The player who plays all of their card or has the fewest left when no more plays are possible, is the winner.

New characteristics and advantages of the invention covered by this document have been set forth in the foregoing description. It will be understood, however, that this disclosure is, in many respects, only illustrative. Changes may be made in detail, particularly in matters of shape, size, and arrangement of parts, without exceeding the scope of the invention. The scope of the invention is, of course, defined in the language in which the appended claims are expressed.

What is claimed is:

1. A board game comprising:

a. a game board having a generally planar upper surface, said upper surface having a plurality of pegs protruding generally perpendicular therefrom, wherein said pegs are arranged in a closed geometric pattern with adjacent pegs spaced generally equidistant from one another; and b. a plurality of game pieces having a pair of generally planar opposing surfaces with a first hole and a second hole extending therethrough, the spacing between said first hole and said second hole about equal to the spacing between said adjacent pegs, so that said game pieces can be slidably received over any pair of adjacent pegs, said game pieces further including a first and a second means for indicating value, said first means located proximate said first hole and said second means located proximate said second hole.

2. The board game of claim 1, wherein said closed geometric pattern is a circle.

3. The board game of claim 1, wherein said plurality of pegs includes twenty six pegs protruding from said planar upper surface and said closed geometric pattern is a circle.

4. The board game of claim 1, wherein said means for indicating value is a number or a blank.

5. The board game of claim 1, wherein said means for indicating value is a color.

6. The board game of claim 1, wherein said means for indicating value is a combination of a number or blank and a color corresponding thereto.

7. The board game of claim 1, wherein said generally planar opposing surfaces of each of said game pieces is rectangular in shape.

8. The board game of claim 7, wherein one of said generally planar opposing surfaces on each of said game pieces is subdivided into a first half and a second half, said first half including said first hole and said first means for indicating value, and said second half including said second hole and said second means for indicating value.

9. The board game of claim 8, wherein said means for indicating value is a number or blank.

10. The board game of claim 8, wherein said means for indicating value is a color.

11. The board game of claim 8, wherein said means for indicating value is a combination of a number or blank and a color corresponding thereto.

12. A board game comprising:

a. a game board having a generally planar upper surface, said upper surface having a plurality of pegs protruding generally perpendicular therefrom, wherein said pegs are arranged in a circular pattern with adjacent pegs spaced equidistant from one another; and b. a plurality of game pieces having a pair of generally planar opposing surfaces with a first hole and a second hole extending therethrough, the spacing between said first hole and said second hole about equal to the spacing between said adjacent pegs, so that said game pieces can be slidably received over any pair of adjacent pegs, said game pieces further including a first and a second means for indicating value, said first means located proximate said first hole and said second means located proximate said second hole, wherein one of said opposing surfaces of each game piece is further subdivided into a first half and a second half, said first half having said first hole and said first means for indicating value thereon and said second half having said second hole and said second means for indicating value thereon.

13. The board game of claim 12, wherein said plurality of pegs includes twenty six pegs protruding from said planar upper surface.

14. The board game of claim 12, wherein said generally planar opposing surfaces of each of said game pieces is rectangular in shape.

15. The board game of claim 12, wherein said means for indicating value is a number or a blank.

16. The board game of claim 15, wherein said plurality of game pieces includes fifty five pieces having first means for indicating value and second means for indicating value including the following combination of values, respectively:

| | | | | | | | | | |
|---|---|---|---|---|---|---|---|---|---|
| blank-1 | 1-1 | 2-2 | 3-3 | 4-4 | 5-5 | 6-6 | 7-7 | 8-8 | 9-9 |
| blank-2 | 1-2 | 2-3 | 3-4 | 4-5 | 5-6 | 6-7 | 7-8 | 8-9 | |
| blank-3 | 1-3 | 2-4 | 3-5 | 4-6 | 5-7 | 6-8 | 7-9 | | |
| blank-4 | 1-4 | 2-5 | 3-6 | 4-7 | 5-8 | 6-9 | | | |
| blank-5 | 1-5 | 2-6 | 3-7 | 4-8 | 5-9 | | | | |
| blank-6 | 1-6 | 2-7 | 3-8 | 4-9 | | | | | |
| blank-7 | 1-7 | 2-8 | 3-9 | | | | | | |
| blank-8 | 1-8 | 2-9 | | | | | | | |
| blank-9 | 1-9 | | | | | | | | |
| blank-blank. | | | | | | | | | |

17. The board game of claim 12, wherein said means for indicating value is a color.

18. The board game of claim 17, wherein said plurality of game pieces includes fifty five pieces and said means for indicating value includes ten different colors in combination as said first means for indicating value and said second means for indicating value so that no two combinations of colors are repeated.

19. The board game of claim 12, wherein said means for indicating value is a combination of a number or blank and a color corresponding thereto.

20. The board game of claim 19, wherein said plurality of game pieces includes fifty five pieces having first means for indicating value and second means for indicating value including the following combination of values and one of ten different colors corresponding thereto, respectively:

| | | | | | | | | | |
|---|---|---|---|---|---|---|---|---|---|
| blank-1 | 1-1 | 2-2 | 3-3 | 4-4 | 5-5 | 6-6 | 7-7 | 8-8 | 9-9 |
| blank-2 | 1-2 | 2-3 | 3-4 | 4-5 | 5-6 | 6-7 | 7-8 | 8-9 | |
| blank-3 | 1-3 | 2-4 | 3-5 | 4-6 | 5-7 | 6-8 | 7-9 | | |
| blank-4 | 1-4 | 2-5 | 3-6 | 4-7 | 5-8 | 6-9 | | | |
| blank-5 | 1-5 | 2-6 | 3-7 | 4-8 | 5-9 | | | | |
| blank-6 | 1-6 | 2-7 | 3-8 | 4-9 | | | | | |
| blank-7 | 1-7 | 2-8 | 3-9 | | | | | | |
| blank-8 | 1-8 | 2-9 | | | | | | | |
| blank-9 | 1-9 | | | | | | | | |
| blank-blank. | | | | | | | | | |

21. The board game of claim 12, further comprising a game piece holder, said holder including a first member having a first peg protruding therefrom and a second member having a second peg protruding therefrom, said first member and said second member sized slidably engage one another with said first and said second peg space a distance equal to the distance between said first hole and said second hole in each of said game pieces.

22. A method for playing a board game, including at least a first player and a second player, comprising the steps of:

a. providing a game board, said game board having a generally planar upper surface, said upper surface having a plurality of pegs protruding generally perpendicular therefrom, wherein said pegs are arranged in a circular pattern with adjacent pegs spaced equidistant from one another;

b. providing a plurality of game pieces, each of said game pieces having a pair of generally planar opposing surfaces with a first hole and a second hole extending therethrough, the spacing between said first hole and said second hole about equal to the spacing between said adjacent pegs, so that said game pieces can be slidably received over any pair of adjacent pegs, said game pieces further including a first and a second means for indicating value, said first means located proximate said first hole and said second means located proximate said second hole, wherein one of said opposing surfaces of each game piece is further subdivided into a first half and a second half, said first half having said first hole and said first means for indicating value thereon and said second half having said second hole and said second means for indicating value thereon;

c. randomly selecting five game pieces by each player, said game pieces arranged so that said first and said second means for indicating value are not visible while randomly selecting said five game pieces, said players further holding said selected game pieces so that they are not visible to other players;

d. placing a first game piece over any pair of adjacent pegs by one of said players with said means for indicating value visible;

e. placing a second game piece, by said second player, over a pair of adjacent pegs, including one peg of said pair utilized by said first game piece, having said first or second means for indicating value matching either the first or second means for indicating value of said first game piece, said matching means for indicating value sharing a common peg, wherein the placement of said second game piece establishes a direction of play in either the clockwise or counterclockwise direction, or alternatively, if said second player holds no game pieces having a first or second means for indicating value matching said first or second means for indicating value on said first game piece, randomly selecting up to three additional game pieces from the remainder of the plurality by said second player, and placing the first of said additional pieces that includes either a first or a second means for indicating value that matches said first or said second means for indicating value of said first game piece on a pair of adjacent pegs with matching means for indicating value overlapping on a shared peg; and, f. alternating play between players wherein each successive player places a game piece having a matching first or second means for indicating value over the non-overlapping means for indicating value exposed on the previously placed game piece, said game piece selected from those held by the player or from up to three additional game pieces selected from the remainder of the plurality, said alternating play continuing until a player no longer holds any game pieces or until no more matches are possible by any player.

* * * * *